United States Patent [19]

Hobbs

[11] Patent Number: 4,825,380

[45] Date of Patent: Apr. 25, 1989

[54] MOLECULAR WEIGHT DETERMINATION FOR CONSTRAINT CONTROL OF A COMPRESSOR

[75] Inventor: James W. Hobbs, Sweeny, Tex.

[73] Assignee: Phillips Petroleum Company, Bartlesville, Okla.

[21] Appl. No.: 52,668

[22] Filed: May 19, 1987

[51] Int. Cl.[4] ..... F04D 27/02

[52] U.S. Cl. ..... 364/499; 364/494; 364/550; 415/11

[58] Field of Search ..... 415/1, 10, 11, 17, 24, 415/51; 364/494, 499, 552, 431.02, 550

[56] References Cited

U.S. PATENT DOCUMENTS

| | | | |
|---|---|---|---|
| 4,156,578 | 5/1979 | Agar et al. | 415/1 |
| 4,203,701 | 5/1980 | Abbey | 415/1 |
| 4,230,437 | 10/1980 | Bellinger et al. | 415/DIG. 1 |
| 4,493,608 | 1/1985 | Paul | 415/51 |

OTHER PUBLICATIONS

Staroselsky, et al., "Improved Surge Control for Centrifugal Compressors" Chemical Engineering, May 21, 1979, pp. 175–184.

*Primary Examiner*—Parshotam S. Lall
*Assistant Examiner*—Ellis B. Ramirez
*Attorney, Agent, or Firm*—George E. Bogatie

[57] ABSTRACT

A supervisory computer is provided for controlling a compressor wherein a computer generated set point manipulates flow in a recycle line from the compressor outlet to inlet. The supervisory computer manipulates the recycle flow so as to prevent the compressor from surging due to changes in flow rate, pressure or the molecular weight of the gas being compressed. The molecular weight of the gas is calculated on-line from actual measurements of flow, pressure, temperature and speed along with compressor performance data that is prestored in the computer. In addition the supervisory computer automatically maintains a minimum flow for the compressor that is as close as possible to the surge limit without danger of putting the compressor into surge due to changes in flow, pressure or molecular weight of the gas being compressed.

12 Claims, 4 Drawing Sheets

MOLECULAR WEIGHT DETERMINATION FOR CONSTRAINT CONTROL OF A COMPRESSOR

This invention relates to automatic control of a compressor. In one aspect it relates to continuously detecting changes in the molecular weight of the gas being compressed. In another aspect it relates to method and apparatus for substantially increasing the operating efficiency of a centrifugal compressor while minimizing the possibility of damage to the compressor due to surging.

Operation of a centrifugal compressor can become unstable and surging can begin due to changes in many conditions such as flow rate, pressure and the molecular weight of the gas. Surging begins at the positively sloped section of the centrifugal compressor curve. This is illustrated in FIG. 1 at the point S of the 100% speed curve. This flow will insure safe operation for all speeds but some power will be wasted at speeds below 100% because the surge limit decreases at reduced speeds. Typically, surge is prevented by recirculating some of the compressed gas to maintain a conservative flow through the compressor. Such a flow is illustrated at point A in FIG. 1. Although an inaccurate surge control point too close to surge limit can put the compressor into deep surge, a conservative surge control point, such as point A or C in FIG. 1, results in useless recycling and wasted horsepower.

As is well known to those skilled in the art the most efficient compressor operation is one where the centrifugal compressor operates as close as possible to the surge line without actually going into surge.

Various schemes have been proposed for controlling the flow of gas in a recycle line connected between the discharge outlet and the suction inlet of a centrifugal compressor system to insure an adequate flow through the compressor even under conditions when the process flow is impeded. Typically a minimum flow controller is employed which normally measures the compressor flow corresponding to a point such as point A in FIG. 1. The minimum flow controller will have a set point corresponding to a flow that will insure safe operation under all expected conditions such as at point C in FIG. 1. As used herein a "minimum flow controller" is a controller that manipulates a flow control valve in the centrifugal compressors recycle line in response to a measured flow corresponding to the compressor flow, and which maintains a minimum flow set point which can be manually or automatically adjusted.

A minimum flow control scheme which has provided an effective solution to the aforementioned problems by utilizing a minimum flow set point close to the surge limit such as point B in FIG. 1 is disclosed in U.S. Pat. No. 4,230,437 issued Oct. 20, 1980 to R. M. Bellinger, et al, which is incorporated herein by reference. The control system disclosed by Bellinger, et al, both prevents surging and substantially minimizes the recirculation of gas. However the system disclosed in that patent requires the establishment of a valve position signal and utilization of a valve position controller and a high select circuit in addition to the minimum flow controller. It would be desirable to control the compressor without the valve position signal and its associated controller and select circuit. Further it would be desirable to automatically compensate for changes in molecular weight, such that changes in the molecular weight of the gas being compressed would not put the compressor into surge.

It is a primary object of this invention to prevent surging of the compressor due to changes in the molecular weight of the gas being compressed. It is another object of this invention to prevent surging of a centrifugal compressor while substantially minimizing the recirculation of gas without requiring a valve position signal. It is a further object of this invention to control a centrifugal compressor without violating a process constraint imposed for a low limit of the suction flow. It is a still further object of this invention to control the compressor without violating an additional constraint for the deviation between the set point and the process measurement for the minimum flow controller.

In accordance with the present invention method and apparatus are provided for on-line calculations of the molecular weight of the gas being compressed from measurements of flow, pressure, temperature and speed. A set point for a minimum flow controller for a centrifugal compressor is computed based on the calculated molecular weight. This set point is increased by an incremental amount for each execution of the computer control program if the suction inlet flow to the compressor is less than its low limit. Also the minimum flow controller set point is increased by an incremental amount if the deviation between the minimum flow controller set point and the actual compressor flow is greater than its high limit. If neither of the aforementioned conditions exist, the minimum flow control set point is incrementally decreased on each execution of the computer control program and in this manner the minimum flow set point is periodically reduced so that the minimum flow set point is moved closer to the surge line of the centrifugal compressor for each execution of the control program if no constraints have been violated.

Essentially in this control action small incremental changes to automatically move the position of the minimum flow control valve toward a fully closed position are periodically repeated until a process constraint is encountered. In this manner the set point for the minimum flow controller is set at a flow rate which results in a substantial minimization of the compressed gas that is recycled to the suction inlet. In addition a constraint is imposed on the maximum deviation between the set point and the process measurement for the minimum flow controller. This controller should include proportional plus reset action and antireset windup. The deviation constraint prevents the possibility of sluggish controller response, which could occur if the process flow suddenly decreased while a high deviation existed. This is because in this situation reset control action would oppose the desired action until the flow measurement approached the set point. Thereby, the minimum flow controller provides rapid response to upsets under all anticipated process conditions by including the deviation constraint.

Other objects and advantages will be apparent from the foregoing brief description of the invention and the claims as well as the brief description of the drawings which are briefly described as follows:

The invention is illustrated and described in terms of a single stage centrifugal compressor. However the invention is applicable to compressor systems having a single stage or two or more stages. The requirement being the availability of instruments to measure the compressor flow, the rpm, the inlet pressure, the outlet pressure, the inner stage pressures, if any, inlet temperature, outlet temperature and interstage temperature, if any.

Figure 1:
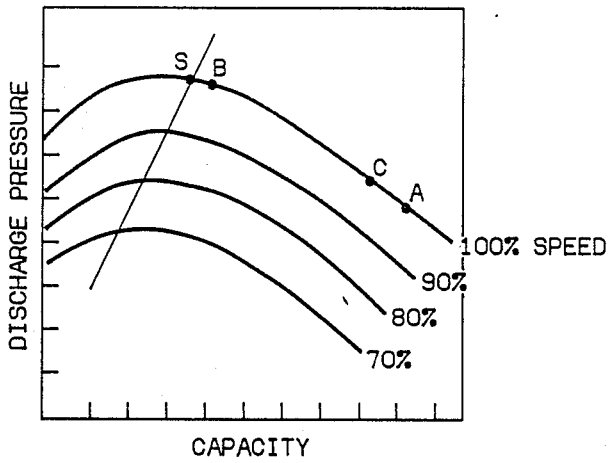
FIG. 1 is a typical family of constant speed curves for a centrifugal compressor.

A specific control system configuration is set forth in FIG. 1 for the sake of illustration. However, the invention extends to different types of control system configurations which accomplish the purpose of the invention. Lines designated as signa lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the at that if a flow is measured in pneumatic form it must be transduced to electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signal based on measured process parameters as well as set points supplied to the computer. Other types of computing devices could also be used in the invention. The digital computer used as an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressure but is also used to refer to binary representations of a calculated or measured value.

The controllers shown may utilize the various modes of control such as proportional, proportional-integral, proportional-derivative, or proportional-integral-derivative. The integral mode of a controller is often referred to as reset action. This is a control action which produces a corrective signal proportional to the length of time a controlled variable has been away from its set point. In this preferred embodiment, proportional-integral-derivative controllers are utilized but any controller capable of accepting two input signals and producing a scaled output signal, representative of a comparison of the two input signals, is within the scope of the invention.

Also the controller utilized in the preferred embodiment includes an antireset windup feature such that when an output or downstream module reaches a limit, the reset action is stopped. This provides for quick control recovery when the process variable comes back from its limiting condition.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Figure 2:
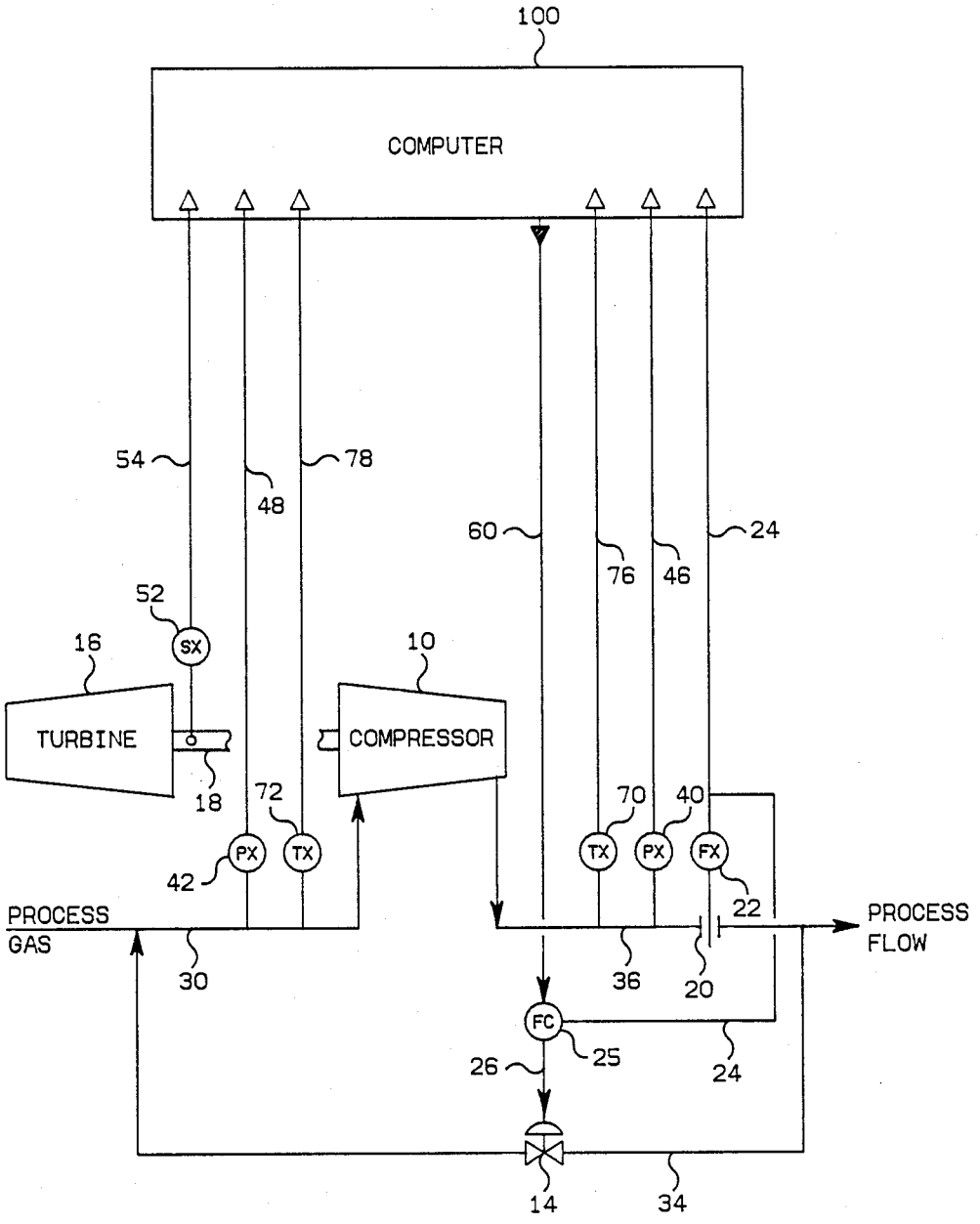
FIG. 2 is a diagrammatic illustration of a centrifugal compressor with the associated control system of the present invention.

Referring to the drawings and in particular to FIG. 2 there is illustrated a centrifugal compressor 10 in which process gas is provided to the suction inlet of the compressor 10 through the conduit means 30. Compressors are gas-handling machines that perform the function of increasing the gas pressure of the gas flowing in the compressor. Compressed gas is recycled from the discharge outlet of the compressor 10 to the suction inlet of compressor 10 through conduit means 34 by opening control valve 14 which is operably located in conduit means 34. The compressor is powdered by a suitable drive means such as a turbine 16, the compressor 10 being connected to the source of power by any suitable means such as a rotating drive shaft 18.

The recycling of compressed gas from the discharge outlet of compressor 10 to the suction inlet of compressor 10 is controlled by utilizing the combination of flow sensor 20 and flow transducer 22 to provide an output signal 24 which is representative of the gas flowing through conduit means 36. Signal 24 is provided as an input signal to flow controller 25 and is also provided as an input signal to computer 100. The flow controller 25 is also provided with a set point signal 60 which, as will be explained more fully hereinafter, is representative of the minimum flow rate of the gas flowing through conduit means 36. The flow controller 25 provides and output signal 26 which is responsive to the difference between signals 24 and 60. Control valve 14 is manipulated in response to signal 26 so as to maintain at least a minimum flow as represented by set point signal 60 in conduit means 36.

In general, control of the compressor system according to the present invention is accomplished by using a plurality of process measurements along with compressor performance data prestored in the computer to establish a control signal. The process measurements will first be described, thereafter the manner in which the process measurements and compressor performance data are utilized to generate the control signal will be described.

Pressure transducers 40 and 42 in combination with pressure sensing devices operably located in conduits 36 and 30 respectively, provide output signals 46 and 48 respectively which are representative of the actual pressures in conduits 36 and 30 respectively. Signals 46 and 48 are provided as inputs to computer 100.

A speed transducer 52, which can be any suitable transducing means such as a tachometer associated with the turbine 16 or with the rotating shaft 18, as illustrated, provides an output signal 54 which is representative of the compressor speed. Signal 54 is provided from speed transducer 52 as an input signal to computer 100.

Temperature transducer 70 and 72 in combination with temperature sensing devices such as thermocouples operably located in conduits 36 and 30 respectively, provide output signals 76 and 78 which are respectively representative of the actual temperatures in conduits 36 and 30.

As previously stated signal 24 is provided from the flow transducer 22 as an input signal to computer 100.

In response to the above described inputs computer 100 provides an output control signal 60 which is representative of the minimum flow required in conduit means 36 to insure operation of the compressor system that is safe from surge disturbances. Signal 60 is provided from computer 100 as a set point signal for flow controller 25. It is noted that while the minimum flow for flow controller 25 is based on the measured flow in conduit means 36 it is also possible to base the minimum flow on measured flows in conduit means 30.

Figure 3:
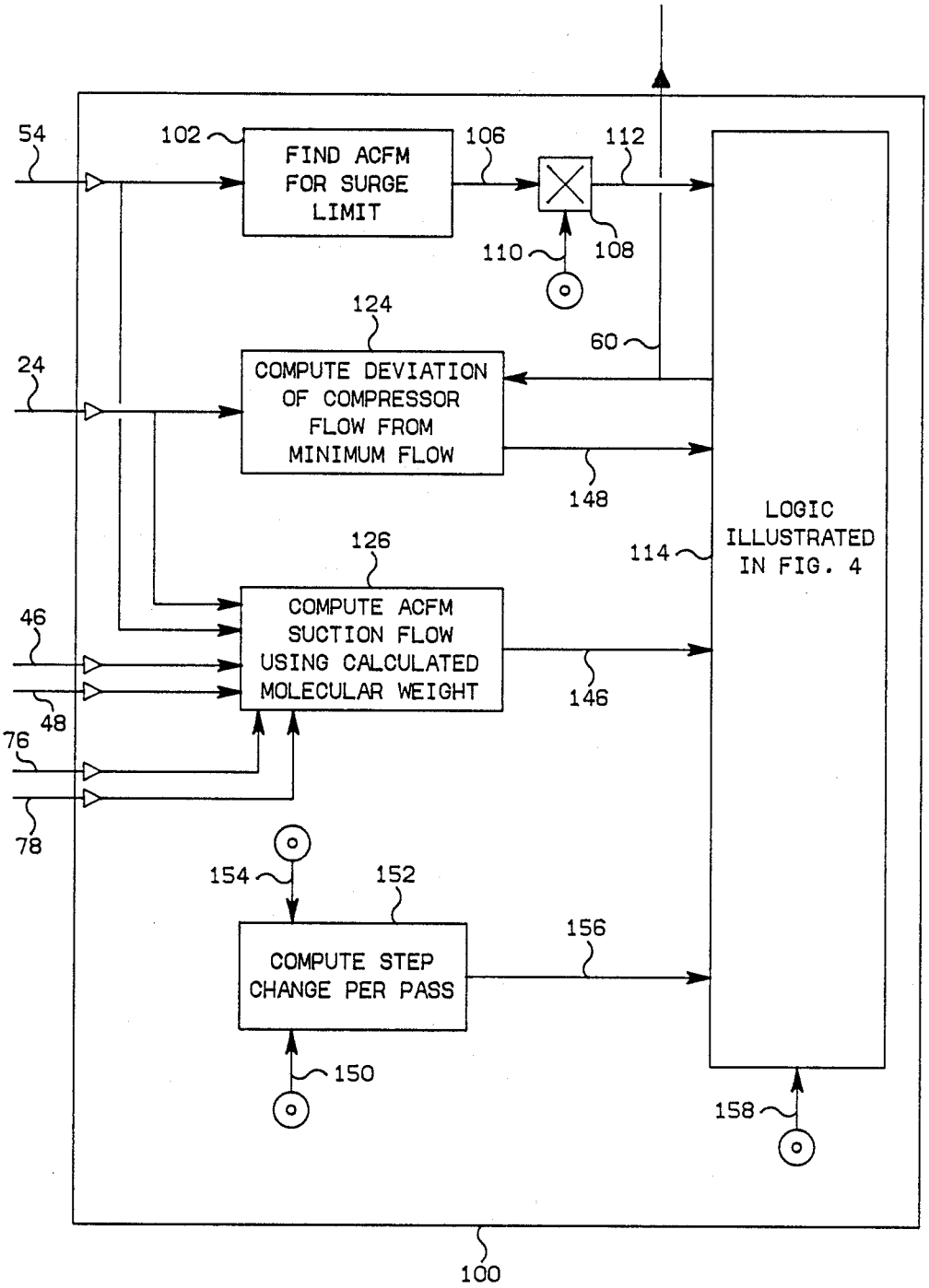
FIG. 3 is a representation of the computer logic suitable for the calculation of the process constraints and various flow rates.

The computer block diagram utilized to calculate control signal 60 in response to the previously described inputs is illustrated in FIG. 3. Referring now to FIG. 3, signal 54 which is representative of the speed of rotating shaft 18 which drives compressor 10 is provided to the "find ACFM for surge limit" computer block 102 and to the "compute ACFM suction flow using calculated molecular weight" computer block 126.

If the compressor speed and the actual cubic feet per minute (ACFM) for the suction flow are known, the ACFM surge limit for the compressor may be determined directly from the compressor manufactures performance curves such as the constant speed compressor curves illustrated in FIG. 1. For example to determine the point S illustrated in FIG. 1, it is only necessary that the information relating compressor speed and flow capacity to the surge limit has been entered into the computer, and stored in the computer in a format which permits recovery of the the information. For example, sets of related numbers for the speed and the corresponding flow for surge limit can be entered in the computer and the surge flow limit corresponding to the measured speed can be quickly found and retrieved. If desired, interpolation between the entered points can be utilized to achieve a desired accuracy.

Computer block 102 provides an output signal 106 which is representative of the flow corresponding to the surge limit for the measured speed. Signal 106 is provided from the computer block 102 as a first input to multiplying block 108. The multiplying block 108 is also supplied with signal 110 which is representative of a desired factory by which the actual low limit for the surge will exceed the actual surge limit. For example an operator may desire to maintain a minimum flow that is 110 percent of the surge limit to maintain a 10 percent safety factor. In this event signal 110 would be representative of 110 percent of the flow rate at the surge limit. Signal 108 is multiplied by signal 110 to establish signal 112 which is representative of the low limit for the suction flow of the compressor. Signal 112 is provided from multiplying block 108 as a first input to logic block 114 for utilization as will be described hereinafter.

Signal 24 which is representative of the flow rate in standard cubic feed per day of the discharge outlet flow of compressor 10 flowing in conduit means 36 is provided to the "compute deviation of process flow from minimum flow" computer block 124 and to the "compute ACFM suction flow using calculated molecular weight" computer block 126. Computer block 126 is also supplied with signals 46 and 48 which are representative of the actual pressure of the discharge outlet and suction inlet respectively, and signals 76 and 78 which are representative of the actual temperature of the gas flow at the the discharge outlet and suction inlet respectively.

Figure 5:
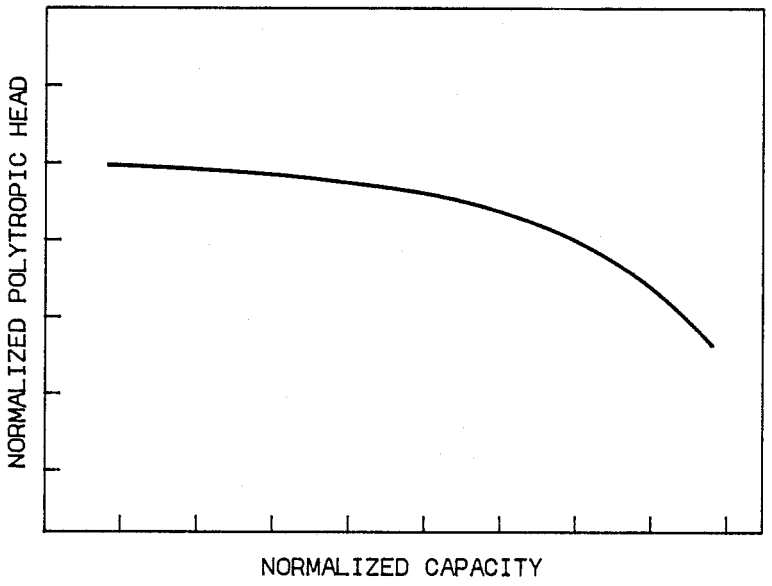
FIG. 5 is a typical compressor performance curve illustrating polytropic head/(speed)$^2$ versus suction flow/speed.

The computer block 126 utilizes an iterative procedure in which a new estimate for molecular weight is determined based on the ratio of measured to calculated discharge pressure. The procedure is repeated until the discharge pressure calculated with the new molecular weight converges to the measured discharge pressure. This procedure requires that data for the manufacturers' performance curve illustrated in FIG. 5 be prestored in the computer. The data corresponding to FIG. 5 is prestored in the digital computer in the same manner as data for FIG. 1 was stored. By entering sets of numbers for the normalized polytropic head and corresponding normalized suction flow, the polytropic head corresponding to a suction flow at a known compressor speed can be quickly found and retrieved. In addition the computer block 126 calculates the ACFM suction flow for use in computer logic block 114. The manner in which the molecular weight and the ACFM flow rates are calculated are set forth in the following FORTRAN listing.

LISTING

```
1   DO 1000  NPASS=1,10
2   QDc=(FD/35)* 4259*(119.7/PD)**0.5 (25.6/CMW)**0.5*
    (TD/742)**0.5
3   QSc = QDc*(PD/PS)*(TS/TD)
4   XR = RPM/7255
5   XQ = QSc/XR
6   CALL NFG (XQ, XH)
7   H = XH*XR*XR
8   M = ALOG (TD/TS)/ALOG(PD/PS)
9   PDc = PS*(H*CMW*M/(Z*1545*TS)+1)**(1/M)
10  PDR = PD/PDc
11  CMW = CMW*(PD/PDc)**0.25
12  IF (CMW LT 10) CMW = 10
13  IF (CMW GT 100) CMW = 100
14  1000 CONTINUE
```

Symbols and constants used in the listing are defined as follows:

$QS_c$=Calculated Actual Suction Flow, CFM,
$QD_c$=Calculated Actual Discharge Flow, CFM,
FD=Discharge Flow Rate as determined by transducer 22, MSCFD,
$PD_c$=Calculated Discharge Pressure, PSIA,
CMW=Calculated Moleculate Weight, lbs/mol.,
TS=Suction Temperature as determined by transducer 72, °R,
TD=Discharge Temperature as determed by transducer 70, °R,
PS=Suction Pressure as determined by transducer 42, PSIA,
PD=Discharge Pressure as determined by transducer 40, PSIA,
RPM=Speed as determined by transducer 52, RPM,
XR=Normalized Speed, RPM,
XQ=Normalized Suction Flow,
NFG=Non Linear Function Generator for generating the curve illustrated in FIG. 5.
XH=Normalized Polytropic Head
H=Polytropic Head, Ft.−lb./lb.
ALOG=Anti-logarithm
M=Calculated factor for polytropic compression
Z=Operator entered constant for gas compressibility, e.g. Z=0.99.

Meter Constants Are:

35=Hi range for flow transducer 22, MSCFD,
4295=Hi range for flow transducer 22, ACFM,
119.7=Flow transducer 22 design pressure, PSIA,
25.6=Molecular weight for meter design,
742=Meter design for temperature transducer 70,
1545=Meter design for temperature transducer 72.

Referring now to the listing, statement 1 requires ten successive executions of the routine. Statements 2 calculates the actual discharge flow in CFM, and for the initial execution of the routine the molecular weight is taken as the normal molecular weight entered by the operator. Statement 3 calculates the suction flow based on the calculated discharge flow and measured suction and discharge pressures and temperatures. In statements 4–6 the polytropic head corresponding to the calculated suction flow and measured compressor speed is determined based on performance data from FIG. 5 which is prestored in the digital computer. Statements 8 through 11 calculate a molecular weight for use in calculating the flows and pressure in the following iteration.

The compressibility factor in statement 9, which is representative of the departure of actual gas from ideal gas behavior, used for compressing an ethylene rich gas was about 0.99. It is noted in statement 11 that the current value of molecular weight is equal to the previous value of molecular weight multiplied by a function of the ratio of the measured discharge pressure to the calculated discharge pressure. In this manner each new value of the molecular weight causes the ratio of measured to calculated discharge pressure to approach unity. The calculated molecular weight that causes this ratio to be unity is the molecular weight of the gas being compressed.

Computer block 126 provides an output signal 146 which is representative of the actual flow rate for the suction flow of compressor 10. Signal 146 is provided from computer block 126 as a second input to logic block 114.

As previously stated signal 24 is provided to computer block 124. Signal 60 which is representative of the minimum flow rate of the gas flowing in conduit means 36 is also provided from logic block 114 to computer block 124. In computer block 124 signal 60 is subtracted from signal 24 from the minimum flow rate represented by signal 60. Signal 148 is provided from computer block 124 as a third input to logic block 114.

Signal 150 which is an operator entered signal representative of the time period in seconds per program pass is provided to the "coompute step change per pass" computer block 152. As used herein a pass is defined as a single execution of a computer program which contains a number of subroutines. Stated another way signal 150 is representative of the time period between consecutive executions of a subroutine which calculates control signal 60 and thereby updates control signal 60 every time period. A value for signal 150 will generally be known. Signal 154 which is representative of the desired rate of change for control signal 60 in MSCFD/HR is provided to the computer block 152. It is noted that in practice of the present invention, changes in signal 154 can be utilized as a tuning adjustment for controller 25. In response to signals 150 and 154 computer block 152 calculates an increment by which control signal 60 is changed for each program pass in accordance with the following formula:

$$STEP=ISEC\ (FR/3600)$$

Where:

STEP=magnitude of increment change for control signal 60, MSCFD.
ISEC=seconds per program pass, seconds.
FR=rate of change for control signal 60, MSCFD/HR.

Signal 156, which is representative of the incremental change per program pass for control signal 60, is provided from computer block 152 as a fourth input to logic block 114. Signal 158, which is representative of a high limit for the deviation of the actual flow rate in conduit means 36 and the minimum flow rate represented by signal 60, is provided as a fifth input to logic block 114.

Figure 4:
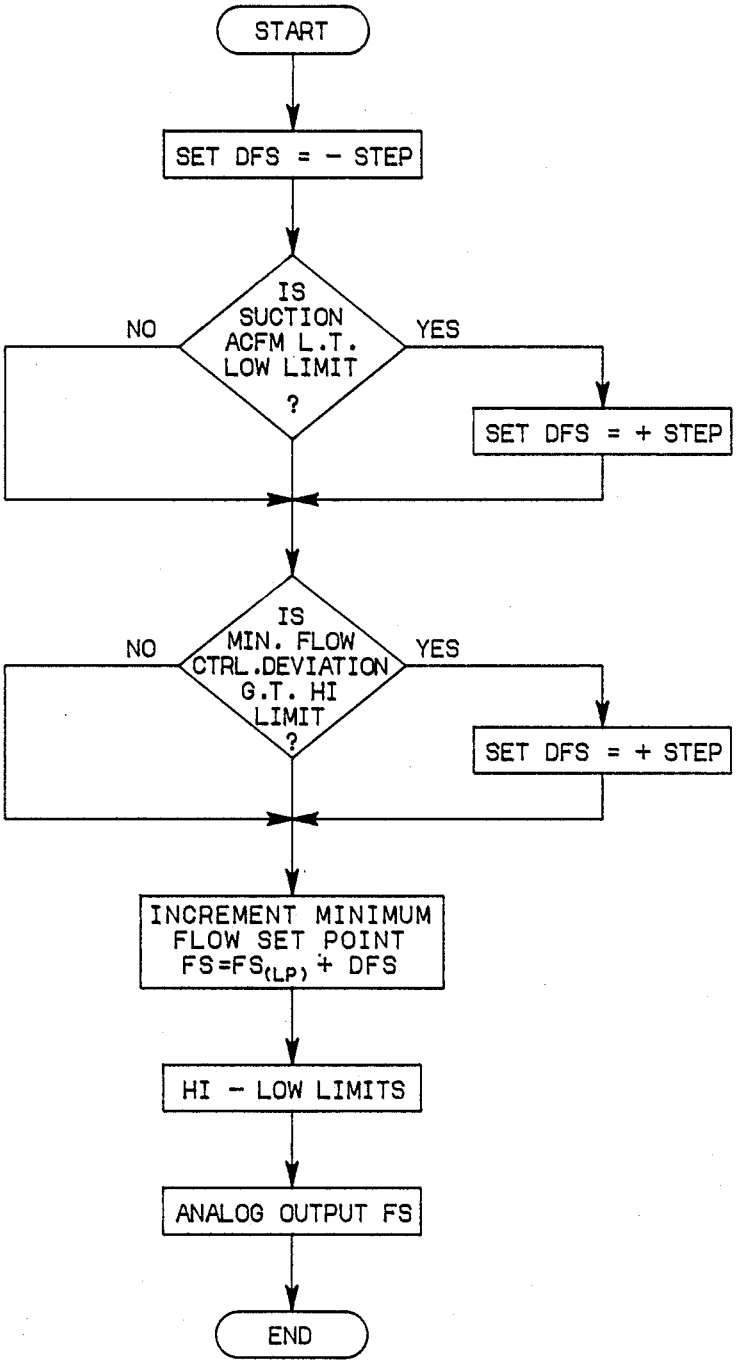
FIG. 4 is a logic flow diagram for the constraint control utilized to generate the set point for the minimum flow controller.

The various signals which are input to logic block 114 as illustrated in FIG. 3, are utilized in the logic diagram illustrated in FIG. 4 to determine an updated value for the set point signal 60. Symbols used in FIG. 4 are defined as follows:

DFS=change for minimum flow set point,
STEP=signal 156,
FS=updated value for signal 60,
$FS_{(LP)}$=current value for signal 60, retained from last update,
Suction Flow=signal 146,
Low limit for suction flow=signal 112.
Deviation=signal 148.
High limit for deviation=signal 158.

Referring now to FIG. 4 the subroutine first sets the term DFS=STEP. This will cause signal 60, which is the set point for the minimum flow controller 25, to be decreased by the increment STEP unless a constraint is violated.

Next a determination is made as to whether a constraint for the low limit flow for the suction has been violated. It is noted, however, that the order in which the determination for the various constraint is made is not critical. Further for a particular system it is not required to determine each of the constraints. For example it may be desirable to only consider the deviation constraint.

If the actual suction flow is less than its lower limit, DFS is set equal to +STEP. This will cause signal 60 to be increased by the increment STEP. If the low limit for first stage suction flow rate has not been violated DFS remains equal to −STEP.

Next a determination is made as to whether a constraint for the deviation of the minimum flow controller 25 has been violated. If the deviation is greater than its high limit the subroutine sets DFS=+STEP. In this manner the subroutine decreases the minimum flow set point on each pass unless a low limit constraint for the suction flow, or a high limit constraint for the deviation of flow controller 25 has been violated.

An updated value for signal 60 is then determined in the sub routine by setting $FS=FS_{(LP)}+DFS$. This will cause signal 60 to increase or decrease according to the value of DFS. It is noted that initially DFS is set equal to −STEP, however violation of any one or more of the constraints will cause DFS to=+STEP.

Next the subroutine checks the signal FS against operator entered high and low limits. If signal 60 is less than a low limit, then signal 60 is set equal to the low limit. It is noted that generally for the initial execution of the subroutine the operator entered low limit signal will determine an initial value for signal 60.

The invention has been disclosed in terms of a preferred embodiment as illustrated in FIGS. 1-5. Specific components which can be utilized in the practice of the invention such as flow sensor 20, flow transducer 22, flow controller 25, pressure transducers 40 and 42, and temperature transducers 70 and 72 and speed transducer 52 are each well known commercially available components such as are described at length in Perry's chemical engineers handbook, 5th edition, chapter 22, McGraw-Hill.

For reason of brevity conventional auxiliary equipment normally associated with a compressor system such as additional measurement and control devices, etc. have not been illustrated since they play no part in the explanation of the invention.

While the invention has been described in terms of the presently preferred embodiment reasonable variations and modifications are possible by those skilled in the art and such variations and modifications are within the scope of the described invention and the appended claims.

That which is claimed is:

1. Apparatus comprising:

(a) a compressor having a suction inlet and a discharge outlet;
(b) means for supplying a gas to the suction inlet of said compressor;
(c) means for flowing the compressed gas from the discharge outlet of said compressor and for recycling at least a portion of said compressed gas in a recycle stream from the discharge outlet to the suction inlet of said compressor;
(d) means for establishing a first signal representative of the actual flow rate of said gas in said compressor;
(e) means for determining the molecular weight of said gas flowing in said compressor, wherein the molecular weight is determined on-line and further wherein the molecular weight is periodically determined so as to provide an essentially continuous determination;
(f) means for establishing a second signal representative of the desired minimum flow rate of said gas in said compressor responsive to the molecular weight of said gas, wherein the minimum flow rate represented by said second signal is a flow rate which will prevent surging of said compressor;
(g) means for comparing said first signal and said second signal and for establishing a third signal representative of the difference between said first signal and said second signal; and
(h) means for manipulating the flow rate of said recycle stream in response to said third signal to thereby maintain the minimum flow of said gas in said compressor substantially equal to the desired minimum flow represented by said second signal.

2. Apparatus in accordance with claim 1 wherein said means for comparing said first signal and said second signal is a controller havng at least proportional and integral modes of control.

3. Apparatus in accordance with claim 1 wherein said second signal is a periodically updated signal having a current value and then one time period later having an updated value, and wherein said means for establishing said second signal further comprises:

means for comparing said first signal and the current value of said second signal and for establishing a ninth signal representative of the deviation of said first signal from the current value of said second signal;

means for establishing a tenth signal representative of a high limit for the deviation represented by said ninth signal; and means for comparing said ninth signal and said tenth signal to determine if a deviation constraint has been violated, wherein an incremental value is added to the current value of said second signal to establish the updated value of said second signal if said ninth signal is greater than said tenth signal, and wherein said incremental value is substrated from the current value of said second signal to establish the updated value of said second signal if said tenth signal is greater than said ninth signal.

4. Apparatus in accordance with claim 1 wherein said first signal is representative of the discharge outlet flow of said compressor and wherein said means for determining the molecular weight of said gas actually flowing in said compressor comprises:

(a) means for establishing a fourth signal representative of the actual rotational speed of said compressor;

(b) means for establishing a fifth signal representative of the actual suction pressure of said compressor;

(c) means for establishing a sixth signal representative of the actual temperature of said gas at the suction inlet of said compressor;

(d) means for establishing a seventh signal representative of the actual temperature of said gas at the discharge outlet of said compressor;

(e) means for establishing an eighth signal representative of the actual discharge pressure of said compressor;

(f) means for calculating the suction pressure of said compressor in response to said first, fifth, sixth, seventh and eighth signals and for normalizing said calculated suction pressure in response to said fourth signal;

(g) means for determining the polytropic head for said compressor in response to said calculated suction pressure determined in paragraph (f);

(h) means for determining an m-factor for polytropic compression in response to said fifth, sixth, seventh and eighth signals;

(i) means for calculating the discharge pressure of said compressor in response to said fifth and sixth signals, said polytropic head determined in paragraph (g), the molecular weight of said gas, said m-factor for polytropic compression, and a gas compressibility constant; and (j) means for determining the molecular weight of said gas actually flowing in said compressor based on the last previously determined value of said molecular weight and a ratio of the actual discharge pressure of said compressor as represented by said eighth signal to the calculated discharge pressure of said compressor determined in paragraph (i).

5. Apparatus in accordance with claim 4 wherein said means for determining the polytropic head for said compressor in response to said calculated suction pressure additionally comprises:

means for storing compressor performance data relating polytropic head to compressor suction pressure in a computer memory in a format which permit recovery of the information; and means for retrieving from said computer memory the value of polytropic head corresponding to the value of said calculated suction pressure.

6. Apparatus in accordance with claim 4 wherein said gas compressibility constant is about 0.99.

7. A method of controlling a compressor wherein a portion of the compressed gas is recycled, and further wherein a minimum flow controller and an associated control valve manipulate gas flow in a recycle stream from the discharge outlet to the suction inlet of said compressor, said method comprising the steps of:

(a) establishing a first signal representative of an actual flow rate of gas flowing in said compressor;

(b) determining the molecular weight of the gas flowing in said compressor, wherein the molecular weight is determine on-line, and further wherein the molecular weight is periodically determined so as to provide an essentially continuous determination;

(c) establishing a second signal representative of the desired minimum flow rate of said gas in said compressor responsive to the molecular weight of said gas wherein the minimum flow rate represented by said second signal is a flow rate which will prevent surging of said compressor;

(d) comparing said first signal and said second signal and establishing a third signal representative of the difference between said first signal and said second signal; and (e) manipulating the flow rate of said recycle stream in response to said third signal to thereby maintain the minimum flow of said gas in said compressor substantially equal to the desired minimum flow represented by said second signal.

8. A method in accordance with claim 7 wherein the step of determining the polytropic head for said compressor in response to said calculated suction pressure additionally comprises:

storing compressor performance data relating polytropic head to compressor suction pressure in a computer memory in a format which permits recovery of the information; and retrieving from said computer memory the value of polytropic head corresponding to the value of said calculated suction pressure.

9. A method in accordance with claim 7 wherein said second signal is a periodically updated signal having a current value and then one time period later having an updated value and wherein said step for establishing said second signal further comprises:

comparing said first signal and the current value of said second signal to establish a ninth signal representative of the deviation of said first signal from the current value of said second signal;

establishing a tenth signal representative of a high limit for the deviation represented by said ninth signal; and comparing said ninth signal and said tenth signal to determine if a deviation constraint has been violated, wherein an incremental value is added to the current value of said second signal to establish the updated value of said second signal if said ninth signal is greater than said tenth signal, and wherein said incremental value is subtracted from the current value of said second signal to establish the updated value of said second signal if said tenth signal is greater than said ninth signal.

10. A method in accordance with claim 7 wherein the step of determining the molecular weight of said gas actually flowing in said compressor comprises:

(a) establishing a fourth signal representative of the actual rotational speed of said compressor;

(b) establishing a fifth signal representative of the actual suction pressure of said compressor;

(c) establishing a sixth signal representative of the actual temperature of said gas at the suction inlet of said compressor;

(d) establishing a seventh signal representative of the actual temperature of said gas at the discharge outlet of said compressor;

(e) establishing an eighth signal representative of the actual discharge pressure of said compressor;

(f) calculating the suction pressure of said compressor in response to said first, fifth, sixth, seventh and eighth signals and normalizing said calculated suction pressure in response to said fourth signal;

(g) determining the polytropic head for said compressor in response to said calculated suction pressure determined in paragraph (f);

(h) determining an m-factor for polytropic compression in response to said fifth, sixth, seventh and eighth signals;

(i) calculating the discharge pressure of said compressor in response to said fifth and sixth signals, said polytropic head determined in paragraph (g), the molecular weight of said gas, said m-factor for polytropic compression, and a gas compressibility constant; and (j) determining the molecular weight of said gas actually flowing in said compressor based on the last previously determined value of said molecular weight and a ratio of the actual discharge pressure of said compressor as represented by said eighth signal to the calculated discharge pressure of said compressor determined in paragraph (i).

11. A method in accordance with claim 10 wherein the steps of paragraphs (f) through (j) are repeated until said ratio of the actual discharge pressure of said compressor as represented by said eighth signal to the calculated discharge pressure of said compressor determined in paragraph (i) approaches unity.

12. A method in accordance with claim 10 wherein said gas compressibility constant is about 0.99.

* * * * *